US007015408B2

(12) United States Patent
Hirahata et al.

(10) Patent No.: US 7,015,408 B2
(45) Date of Patent: Mar. 21, 2006

(54) SWITCH UNIT CAPABLE OF DIRECTLY ILLUMINATING SWITCH OPERATING POSITION

(75) Inventors: Hiroshi Hirahata, Iizuka (JP); Shuuji Teruyama, Iizuka (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/929,534

(22) Filed: Aug. 30, 2004

(65) Prior Publication Data

US 2005/0103610 A1 May 19, 2005

(30) Foreign Application Priority Data

Nov. 19, 2003 (JP) ..... 2003-389712

(51) Int. Cl.
*H01H 9/20* (2006.01)

(52) U.S. Cl. ..... 200/310; 200/512; 200/314; 200/317

(58) Field of Classification Search ..... 200/5 A, 200/600, 512–517, 406, 310–317; 341/22; 345/168–170, 173, 176
See application file for complete search history.

(56) References Cited

U.S. PATENT DOCUMENTS

| | | | | |
|---|---|---|---|---|
| 4,558,427 | A | 12/1985 | Takeuchi et al. | |
| 5,901,834 | A * | 5/1999 | Inubushi et al. | 200/314 |
| 5,950,808 | A * | 9/1999 | Tanabe et al. | 200/314 |
| 6,198,060 | B1 * | 3/2001 | Yamazaki et al. | 200/305 |
| 6,313,762 | B1 * | 11/2001 | Crowley et al. | 341/22 |
| 6,595,653 | B1 * | 7/2003 | Saito et al. | 362/84 |
| 6,765,503 | B1 * | 7/2004 | Chan et al. | 341/22 |
| 6,803,903 | B1 * | 10/2004 | Ostergård et al. | 345/168 |
| 6,837,604 | B1 * | 1/2005 | Douzono et al. | 362/545 |

FOREIGN PATENT DOCUMENTS

| | | |
|---|---|---|
| EP | 1398808 | 3/2004 |
| JP | 2002-352657 | 12/2002 |
| JP | 2003-077366 | 3/2003 |
| WO | 02 097837 | 12/2002 |

* cited by examiner

*Primary Examiner*—Michael A. Friedhofer
(74) *Attorney, Agent, or Firm*—Ladas & Parry LLP

(57) ABSTRACT

A switch unit includes a first sheet member that includes a movable contact. A second sheet member is provided on the first sheet member. The second sheet member includes a light-emitting part and wiring. The wiring supplies power to the light-emitting part. The wiring is made of a conductive polymer.

20 Claims, 4 Drawing Sheets

1A

SWITCH UNIT CAPABLE OF DIRECTLY ILLUMINATING SWITCH OPERATING POSITION

BACKGROUND OF THE INVENTION

1. Field of the Invention

The present invention generally relates to switch units and, more particularly, to a switch unit that illuminates a switch operating position.

2. Description of the Related Art

In order to improve operability in dark places such as nighttime, portable electronic devices typified by mobile phones, for example, are provided with an illumination function of illuminating the vicinities of positions at which key tops are provided. Japanese Laid-Open Patent Application No. 2003-77366, for example, discloses a switch unit provided with such an illumination function. FIG. 1 shows a conventional switch unit 50 provided with such an illumination function.

The switch unit 50 generally includes a first sheet member 52 and a second sheet member 53. The first sheet member 52 includes a cover sheet 54 and dome movable contacts 55. The cover sheet 54 is a sheet made of an insulating resin and has a function of protecting the dome movable contacts 55. The dome movable contacts 55 are made of a conductive metal and are formed into dome-like shapes. When pressed, the dome movable contacts 55 elastically move in up and down directions in FIG. 1.

As shown in FIG. 1, the first sheet member 52 is provided on a wiring substrate 56, thereby forming push button switches. The wiring substrate 56 includes ring fixed contacts 58 and fixed contacts 57 formed in the center positions of the ring fixed contacts 58. The outer peripheries of the dome movable contacts 55 are connected to the ring fixed contacts 58. Thus, when the dome movable contacts 55 are pressed and moved, and the center portions thereof contact the fixed contacts 57, the fixed contacts 57 and the ring fixed contacts 58 are electrically connected via the dome movable contacts 55. Hence, the push button switches are formed by the dome movable contacts 55, the fixed contacts 57, and the ring fixed contacts 58.

The second sheet member 53 includes a plurality of illumination parts 60 formed between a first base member 61 and a second base member 62. Each of the illumination parts 60 is formed by a light-emitting part 63 and first and second transparent electrodes 64 and 65 interposing the light-emitting part 63 therebetween. The light-emitting part 63 emits light by supplying power thereto from each of the first and second transparent electrodes 64 and 65. The first and second transparent electrodes 64 and 65 are formed by an indium-tin oxide (hereinafter referred to as "the ITO") that is transparent and having conductivity. The reference numeral 70 designates an air pathway forming spacer.

However, since the conventional switch unit 50 uses the first and second transparent electrodes 64 and 65 made of the ITO as the electrodes for supplying power to the light-emitting parts 63, there are problems in that the thickness of the second sheet member 53 is increased, which prevents reduction of the thickness of the switch unit 50, and that the positions pressed by a user when using the switch unit 50 cannot be directly illuminated.

A description is given below of each of the above-mentioned problems.

First, a description is given of the problem that the thickness of the second sheet member 53 is increased. The first and second transparent electrodes 64 and 65 are formed by depositing the ITO on the base members 61 and 62, respectively. It is preferable that the first and second transparent electrodes 64 and 65 have low resistance in terms of ensuring power supply to the light-emitting parts 63 and saving power. In these respects, the ITO has low resistance for a transparent electrode material and is a material having a good electric property.

However, since the base members 61 and 62 are made of resin such as PET (polyethylene terephthalate), in order to achieve the good electric property of the ITO, it is necessary for the base members 61 and 62 to have a thickness with which the base members 61 and 62 do not warp at the time of deposition. Hence, in the conventional switch unit 50, there is a problem in that the thickness and rigidity of the second sheet member 53 are increased, which results in increases in the thickness and rigidity of the switch unit 50.

As mentioned above, it is preferred as is generally known that the size and thickness of a portable electric device typified by a mobile phone be reduced. Thus, there is a problem in that the increase in the thickness of the switch unit 50 prevents reduction of the size and thickness of a portable electronic device that incorporates the switch unit 50 therein. In addition, if the thickness of the switch unit 50 is increased, then the rigidity of the switch unit 50 is increased. When the rigidity of the switch unit 50 is increased, it becomes difficult or impossible to make the switch unit 50 to be flexibly deformed as a flexible substrate, which causes a problem of poor mounting to the portable electronic device.

On the other hand, since the ITO is a metal oxide (indium-tin oxide) and a thin film, when the ITO is continuously subjected to deformation and biasing, metal fatigue may occur. Hence, in the case where each of the first and second transparent electrodes 64 and 65 formed by the ITO is provided directly on one of the dome movable contacts 55 and is deformed and biased every time the switch is operated, it is conceivable that the first and second transparent electrodes 64 and 65 may be damaged in a relatively short period of time. Hence, conventionally, as shown in FIG. 1, the transparent electrodes 64 and 65 are not provided directly on the dome movable contacts 55. That is, the first and second transparent electrodes 64 and 65 are provided on the outer peripheries of the dome movable contacts 55.

On the other hand, when operating the switch unit 50 in a dark place, it is preferable in terms of operability to illuminate the position at which the operation is directly performed, that is, the position at which the dome movable contact 55 is provided. However, because of the above-mentioned reasons, it has been conventionally difficult or impossible to directly illuminate the position that is pressed when operating the switch unit 50. Hence, usability of the switch unit 50 has not been fully satisfactory.

SUMMARY OF THE INVENTION

A general object of the present invention is to provide an improved and useful switch unit in which one or more of the above-mentioned problems are eliminated.

Another and more specific object of the present invention is to provide a switch unit capable of directly illuminating a switch operating position while reducing the thickness and rigidity thereof.

In order to achieve the above-mentioned objects, according to one aspect of the present invention, there is provided a switch unit including:

a first sheet member including a movable contact; and a second sheet member provided on the first sheet member and including a light-emitting part and wiring that supplies power to the light-emitting part;

wherein the wiring is made of a conductive polymer.

A conductive polymer is more flexible than the conventionally used ITO (indium-tin oxide). In addition, differing from the ITO, a conductive polymer is not formed by deposition. Hence, there is substantially no limitation to the thickness of a base member and thus it is possible to reduce the thickness of the base member. Accordingly, it is possible for the light-emitting part to emit high-intensity light without variation while reducing the thickness and rigidity of the second sheet member.

In an embodiment of the present invention, the light-emitting part and the movable contact may be arranged to face to each other at least partially.

According to this embodiment, since the light-emitting part and the movable contact are arranged to face to each other at least partially, a portion subjected to a switch operation by a user is directly illuminated. Hence, it is possible to increase the usability of the switch unit.

In an embodiment of the present invention, the conductive polymer may be transparent.

According to this embodiment, since an uncolored transparent conductive polymer is used, it is possible to transmit the color of light emitted from the light-emitting part as it is to the outside without being affected by the conductive polymer.

In an embodiment of the present invention, the movable contact may be formed by a dome-like metallic spring.

According to this embodiment, since the movable contact is formed by a dome-like metallic spring, it is possible to obtain a feeling of clicking caused by deformation of the metallic spring at the time of a switching operation. On this occasion, since the thickness and rigidity of the second sheet member are reduced by using the conductive polymer as the electrode, it is possible to positively obtain the feeling of clicking. Thus, it is possible to improve operability.

In an embodiment of the present invention, the wiring may supply power to the light-emitting part at a position facing the movable contact.

According to this embodiment, since power is supplied to the light-emitting part at the position facing the movable contact, which is a light emission position, it is possible to increase brightness at the position of the movable contact (that is, the switch operating position). In other words, since luminous efficiency of the light-emitting part is high at a position where power is supplied, by arranging the power supply position to a position facing the movable contact, it is possible to increase brightness at the position of the movable contact (switch operating position).

In an embodiment of the present invention, the light-emitting part may be formed to cover substantially an entire surface of the second sheet member.

According to this embodiment, it is possible to illuminate substantially an entire surface (wide area) of the second sheet member while reducing the thickness and rigidity of the second sheet member.

In an embodiment of the present invention, a spacer may be provided between the first sheet member and the second sheet member.

According to this embodiment, since the spacer is provided between the first sheet member and the second sheet member, even if the rigidity of the second sheet member is reduced, it is possible to ensure planarity of the second sheet member in a state where the second sheet member is stacked (provided) on the first sheet member.

In an embodiment of the present invention, a resin may be supplied to fill in between the first sheet member and the second sheet member so that the first sheet member and the second sheet member constitute an integrated structure.

According to this embodiment, since the first sheet member and the second sheet member are integrated by the resin, it is possible to position the movable contact provided to the first sheet member and the light-emitting part provided to the second sheet member with good accuracy. Thus, it is possible to positively illuminate the switch operating position.

Other objects, features and advantages of the present invention will become more apparent from the following detailed description when read in conjunction with the following drawings.

DETAILED DESCRIPTION OF THE PREFERRED EMBODIMENTS

A description is given below of a preferred embodiment of the present invention with reference to the drawings.

Figure 2:
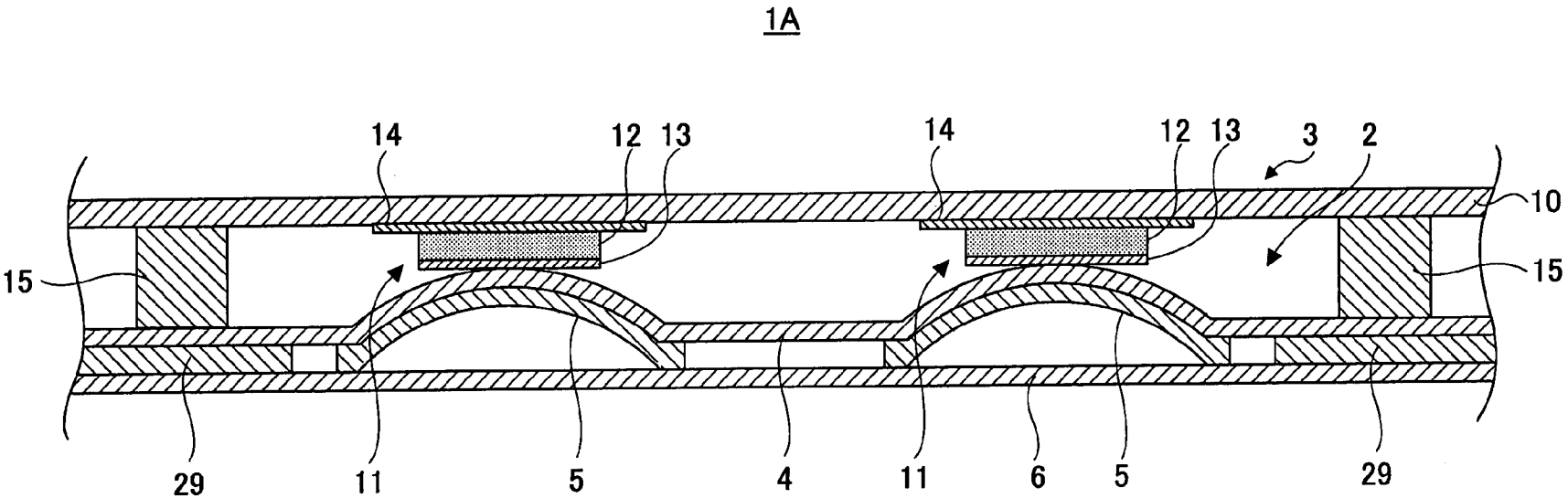
FIG. 2 is a cross-sectional view of a switch unit according to one embodiment of the present invention.
Figure 3:
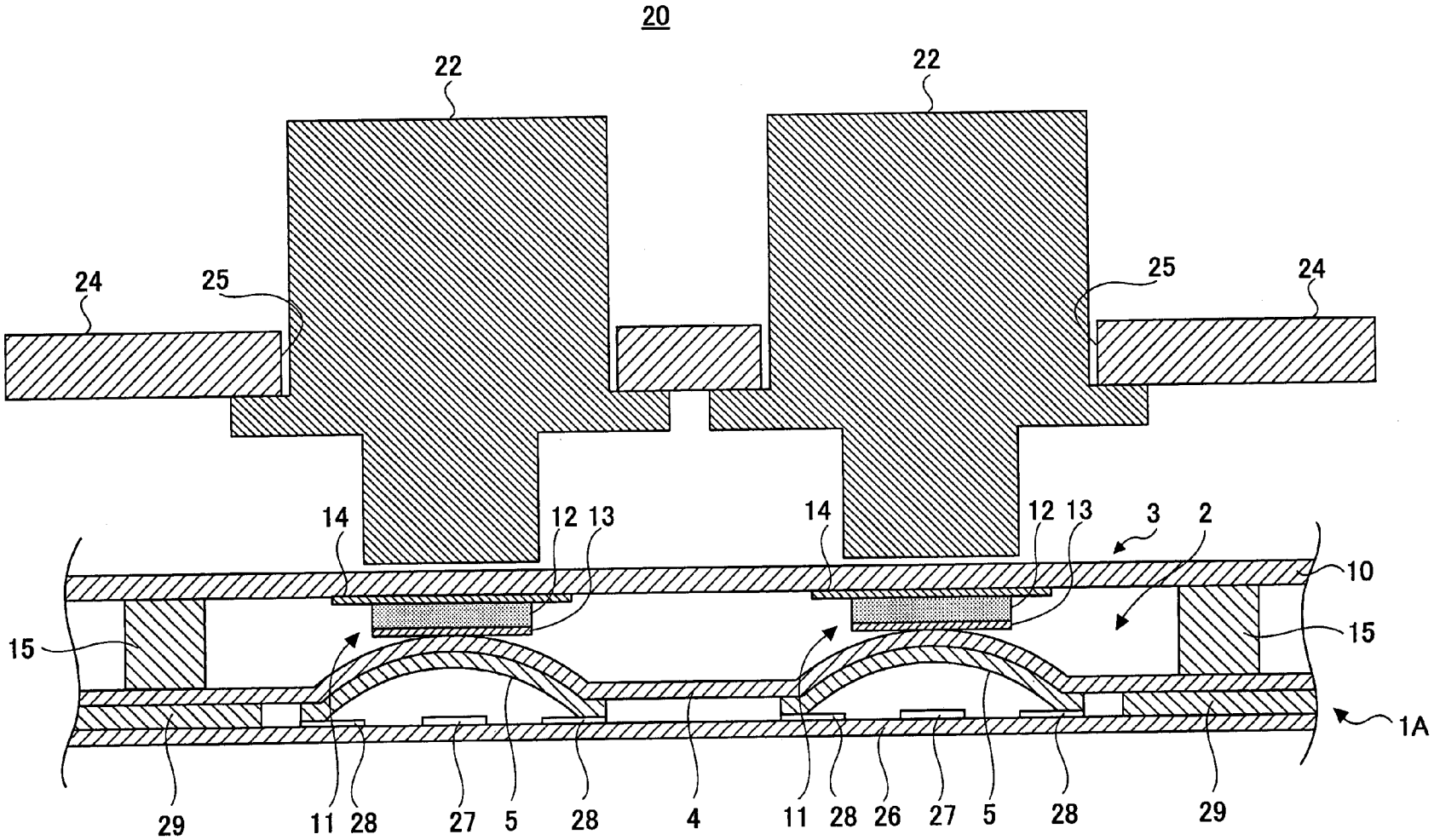
FIG. 3 is a cross-sectional view of an electronic device using the switch unit according to the embodiment of the present invention.

FIG. 2 shows a switch unit 1A according to one embodiment of the present invention. FIG. 3 shows an electronic device 20 incorporating the switch unit 1A therein. The switch unit 1A is added with an illuminating function and used by being incorporated in the electronic device 20 as shown in FIG. 3.

The switch unit 1A generally includes a first sheet member 2 and a second sheet member 3. The first sheet member 2 includes a cover sheet 4, dome movable contacts 5, and an air pathway forming spacer 29. The cover sheet 4 is a sheet made of an insulating resin such as polyethylene terephthalate (PET) or polycarbonate, and includes a function of protecting the dome movable contacts 5. Since the dome movable contacts 5 are elastically deformed as mentioned below, a flexible material capable of following such elastic deformation is selected for the dome movable contacts 5.

The air pathway forming spacer 29 is a sheet having a predetermined thickness (for example, 50 $\mu$m) made of a resin such as polyethylene terephthalate (PET). The air pathway forming spacer 29 includes an adhesive layer on each of the top surface and the bottom surface thereof. The air pathway forming spacer 29 is bonded and fixed to the cover sheet 4 by the adhesive layer on the top surface, and bonded and fixed to a wiring substrate 6 (described below) by the adhesive layer on the bottom surface, thereby forming air pathways connecting spaces between the dome movable contacts 5 (the air pathway forming spacer 29 is hollowed out at regions corresponding to the dome movable contacts 5 and at a pathway pattern, and air pathways are formed by the cover sheet 4 and the wiring substrate 6).

The dome movable contacts 5 are made of a conductive metal having spring properties or a conductive material (a material obtained by mixing, e.g., carbon in, e.g., rubber)

capable of being elastically deformed, and formed into dome shapes. The dome movable contacts 5 are elastically deformed by being pressed, and move in the up and down directions in FIG. 2. The dome movable contacts 5 and fixed electrodes 27 and 28 (described below) form a push button switch.

When elastically deformed by being pressed as mentioned above, the dome movable contacts 5 generate a feeling of clicking. With the feeling of clicking, it is possible for a user to confirm by the sensation introduced to a finger that a switching operation is positively performed.

It should be noted that FIG. 2 shows a mode in which the switch unit 1A is shipped after being manufactured. Thus, a protection tape 6 is applied to the bottom surface of the first sheet member 2. The protection sheet 6 is for protecting the dome movable contacts 5 during shipping of the switch unit 1A. Accordingly, the protection sheet 6 is removed when mounting the switch unit 1A to, for example, the electronic device 20.

On the other hand, the second sheet member 3 is formed by a base member 10 and a plurality of illumination parts 11 formed thereon. The base member 10 is a sheet made of a transparent insulating resin such as polyethylene terephthalate (PET) or polycarbonate. The base member 10 is pressed by the user when operating the switch unit 1A as described below. Thus, the base member 10 is configured to be flexible.

Each of the illumination parts 11 is formed by a light-emitting part 12 and a pair of electrodes 13 and 14 (a base electrode 13 and a conductive polymer electrode 14) interposing the light-emitting part 12 therebetween. Zinc sulfide (ZnS) doped with copper (Cu), for example, may be used as an illuminator of the light-emitting part 12.

The illuminator is print formed by, for example, the thick film printing method (for example, screen printing), after being combined with a fluorocarbon resin binder (dissolved into methyl ethyl ketone by using a copolymer of vinylidene fluoride and propylene hexafluoride as a solvent). The light-emitting part 12 thus formed emits light by supplying power thereto from the pair of electrodes 13 and 14.

Each of the base electrodes 13 is formed on a surface of the corresponding one of the light-emitting parts 12, which surface faces the corresponding one of the dome movable contacts 5. The base electrode 13 is formed by printing a silver paste on the light-emitting part 12 by using, for example, the thick film printing method, and then vaporizing a binder by a heating process.

Since the base electrodes 13 include silver (Ag) as their main constituent, the base electrodes 13 have metallic luster. Hence, the base electrodes 13 also serve as reflectors that reflect light emitted by the light-emitting parts 12. It should be noted that a metal forming the base electrodes 13 is not limited to silver and various conductive materials may be used such as gold, copper, nickel, aluminum, or a conductive polymer combined with, for example, a metal material.

The conductive polymer electrodes 14 are formed between the light-emitting parts 12 and the base member 10. Various materials may be used for the conductive polymer electrodes 14, such as polyacetylene, poly(p-phenylene), polypyrrole, polythiophene, polyaniline, poly-phenylene vinylene, and polyselenophene. Particularly when using the conductive polymer electrodes 14 for the electronic device 20 such as a mobile phone as in this embodiment, it is preferable to use polypyrrole, polythiophene, or polyaniline, having high stability, transparency, and conductivity. The conductive polymer electrodes 14 may be formed on the base member 10 by using the thick film printing method.

The conductive polymer electrodes 14 made of one of the above-mentioned materials are transparent and, since they are polymer, more flexible than the ITO that has been conventionally used. In addition, different from the ITO, the conductive polymer electrodes 14 have low temperature dependency in terms of electric properties. Hence, even if the temperature of the base member 10 is not made high when forming the conductive polymer electrodes 14, it is possible to form the conductive polymer electrodes 14 having low resistance. Further, in the conductive polymer electrodes 14, reduction of electric resistance caused by an increase in the thickness is less. Hence, even if the thicknesses of the conductive polymer electrodes 14 are reduced, it is possible for the electric resistance to be low.

Figure 1:
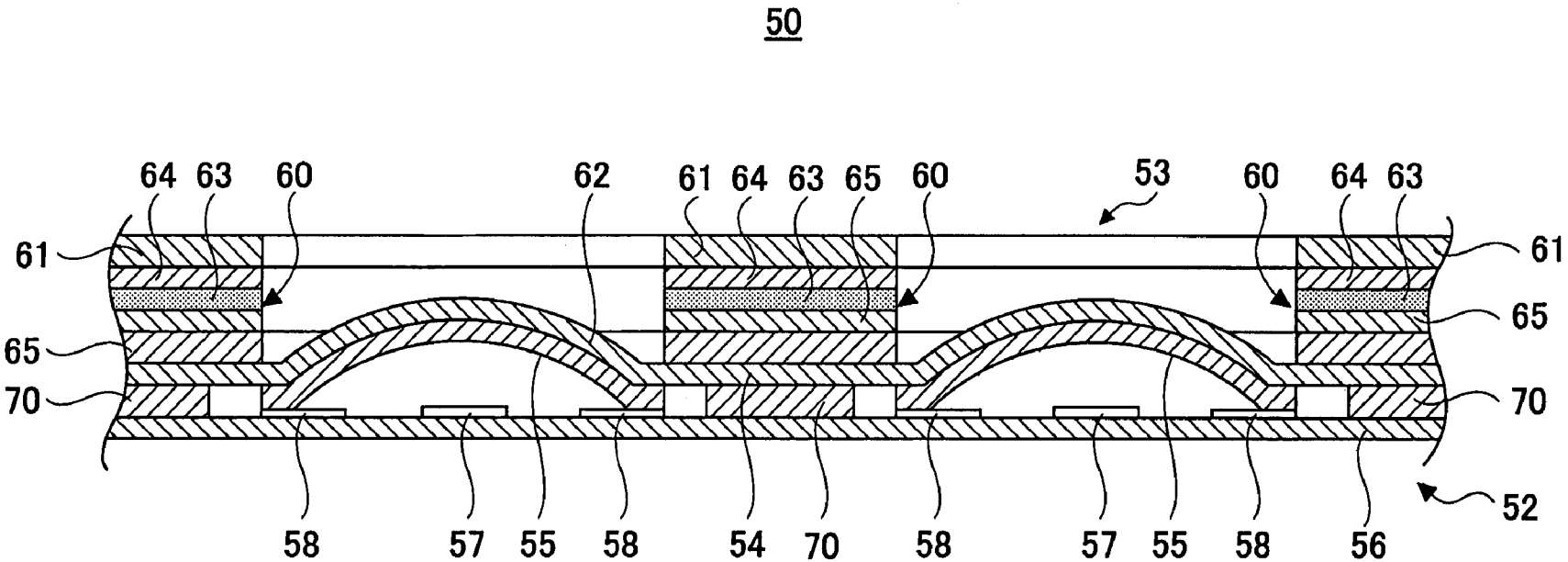
FIG.1 PRIOR ART
FIG. 1 is a cross-sectional view of a conventional switch unit.

Specifically, in the conventional transparent electrodes 64 and 65 (see FIG. 1) made of the ITO and having a thickness of 0.5 $\mu$m, the sheet resistance value is 200–300 Ω/sqr. By using the conductive polymer electrodes 14 as in this embodiment, it is possible to realize 200–300 Ω/sqr, which is equivalent to the sheet resistance value of the ITO, with a thickness of 3 $\mu$m. Additionally, by using the conductive polymer that can be formed by a printing method for the transparent electrodes, limitations on the thickness of the base member 10 are eliminated. Thus, it is possible to realize the base member 10 having a thickness of 12 $\mu$m in this embodiment, whereas the thicknesses of the conventional base members 61 and 62 were 100–125 $\mu$m. Since the thickness of the base member 10 can be reduced, the thickness of the second sheet member 3 can also be reduced to a tenth of the conventional thickness.

As mentioned above, by using the conductive polymer electrodes 14 that do not impose limitations on the base member 10, it is possible to reduce the thickness of the switch unit 1A. In addition, since the conductive polymer electrodes 14 are flexible, and the thickness of the base member 10 can be reduced so as to obtain sufficient flexibility, it is possible to reduce the rigidity of the second sheet member 3 to be low.

The first sheet member 2 and the second sheet member 3 configured as mentioned above are bonded via first spacers 15. In the switch unit 1A according to this embodiment, in a state where the first sheet member 2 and the second sheet member 3 are bonded to each other via the first spacers 15, the illumination parts 11 are arranged to face the corresponding dome movable contacts 5. That is, in the state where the first sheet member 2 and the second sheet member 3 are bonded, the light-emitting parts 12 and the electrodes 13 and 14 supplying power thereto face the corresponding dome movable contacts 5.

On this occasion, the area of each light-emitting part 12 may be smaller than, equal to, or larger than the area of the corresponding dome movable contact 5. Thereby, when the state where the first sheet member 2 and the second sheet member 3 are bonded is seen from above, each light-emitting part 12 overlaps at least a part of the corresponding dome movable contact 5. With such a configuration, portions subjected to a switching operation by the user of the switch unit 1A are directly illuminated by the light-emitting parts 12. Accordingly, it is possible to improve usability of the switch unit 1A. In addition, as mentioned above, since the rigidity of the second sheet member 3 is reduced and the second sheet member 3 is easily bent in this embodiment, it is possible to reduce a pressing force required for the switching operation compared to that conventionally required. This can also improve the usability.

It should be noted that, even if the rigidity of the second sheet member 3 is reduced, since it is supported by the first spacers 15, it is possible to positively maintain planarity. In addition, since the regions where the dome movable contacts 5 are provided are smaller than the entire area of the switch unit 1A, it is possible to allow freedom in the positions at which the first spacers 15 are provided. Thus, it is possible to provide the first spacers 15 at the positions that are preferable to maintain the planarity of the second sheet member 3, which can also increase the planarity of the second sheet member 3.

The switch unit 1A thus structured is attached to the electronic device 20 as shown in FIG. 3. In the attached state, the first sheet member 2 is arranged on the wiring substrate 26 to form the push button switch. The wiring substrate 26 includes ring fixed contacts 28 and fixed contacts 27 formed substantially at the center positions of the ring fixed contacts 28.

The outer peripheries of the dome movable contacts 5 are connected to the fixed contacts 28. Thus, when the dome movable contact 5 is pressed and moved such that the center portion thereof contacts the fixed contact 27, the fixed contact 27 and the ring fixed contact 28 are electrically connected via the dome movable contact 5. Thus, the dome movable contacts 5, the fixed contacts 27 and the ring fixed contacts 28 form the push button switch.

On the other hand, a housing 24 is arranged on the second sheet member 3. The housing 24 serves as an exterior case of the electronic device 20 and is made of a hard resin. Additionally, openings 25 are formed in the housing 24 at positions facing the dome movable contacts 5.

Key tops 22 are formed to project past a top surface of the housing 24 via the openings 25 for a predetermined amount.

The positions at which the openings 25 are formed correspond to the positions at which the dome movable contacts 5 are formed. Accordingly, when one of the key tops 22 is moved downward by a pressing operation of the key top 22 by the user, the key top 22 presses the corresponding illumination part 11 of the second sheet member 3. As a result, the base member 10 is bent downward, which deforms and bends downward the corresponding light-emitting part 12, base electrode 13, and conductive polymer electrode 14.

Additionally, since the illumination part 11 is deformed and bent downward as mentioned above, the dome movable contact 5 is elastically deformed, and the center portion thereof contacts the fixed contact 27. Thereby, the fixed contact 27 and the ring fixed contact 28 are electrically connected via the dome movable contact 5.

Further, when the dome movable contact 5 is elastically deformed as mentioned above, the dome movable contact 5 generates a feeling of clicking. Thus, the user can determine by the feeling of clicking whether the switch is appropriately operated. Hence, it is possible to improve the operability of the electronic device 20. It should be noted that, when the pressing operation with respect to the key top 22 is cancelled, the key top 22 moves upward to the position before the pressing operation mainly by elastic restoration forces of the dome movable contact 5 and the second sheet member 3.

At the time of the switching operation, power is previously supplied to the light-emitting parts 12 via the corresponding base electrodes 13 and conductive polymer electrodes 14. In the case where the electronic device 20 is a flip mobile phone, the power supply is started when a cover part is opened with respect to a mobile phone body having the key tops 22 arranged thereon. By supplying power to the light-emitting parts 12 via the corresponding electrodes 13 and 14, the light-emitting parts 12 emit light to illuminate the key tops 22.

On this occasion, since the conductive polymer electrodes 14 are transparent, the color of the light emitted by the light-emitting parts 12 can be supplied toward the key tops 22 as it is without being affected by the conductive-polymer electrodes 14. In addition, since the base member 10 and the key tops 22 are also transparent, the user of the electronic device 20 can see the light from the light-emitting parts 12 via the key tops 22, the base member 10, and the conductive polymer electrodes 14.

Additionally, as mentioned above, since the switch unit 1A according to this embodiment uses the conductive polymer electrodes 14, it is possible to arrange each of the electrodes 13 and 14 to the position facing the corresponding dome movable contact 5. Thus, it is possible to supply power to the light-emitting parts 12 at the positions facing the dome movable contacts 5. The luminous efficiency of the light-emitting parts 12 is high at power supplying positions. Hence, with the configuration according to this embodiment, it is possible to increase the brightness (luminance) of the positions at which the dome movable contacts 5 are provided, in other words, the key tops 22, and to prevent variation in light emission. Accordingly, it is possible to improve the usability of the electronic device 20 at a dark place.

Further, as mentioned above, the conductive polymer electrodes 14 are more flexible than the conventionally used ITO (indium-tin oxide) and do not impose limitations on the thickness of the base member 10. Hence, it is possible for the light-emitting parts 12 to emit high-intensity light without variation while reducing the thickness and rigidity of the second sheet member 3. Accordingly, it is possible to improve the usability of the key tops 22 while reducing the size and thickness of the electronic device 20.

Figure 4:
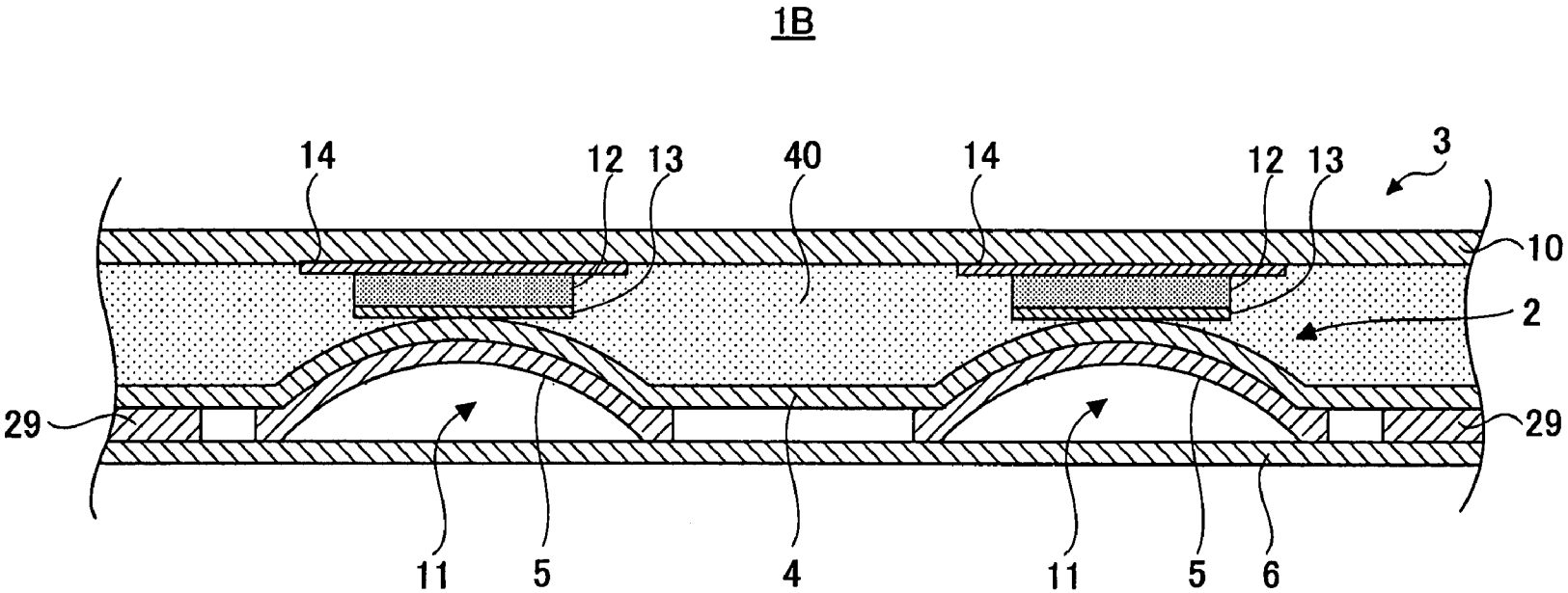
FIG. 4 is a cross-sectional view of a switch unit according to a variation of the switch unit shown in FIG. 2.

FIG. 4 shows a switch unit 1B according to a variation of the above-mentioned switch unit 1A. In FIG. 4, those parts that are the same as those corresponding parts in FIGS. 2 and 3 are designated by the same reference numerals, and a description thereof is omitted.

In the switch unit 1B according to this variation, a resin 40 is provided (is supplied to fill in) between the first sheet member 2 and the second sheet member 3, thereby integrally forming the first sheet member 2 and the second sheet member 3.

A flexible material, such as silicone resin, is selected for the resin 40. Thus, even if the resin 40 is provided, the usability of the switch unit 1B is not reduced. That is, though it is conceivable that the flexibility of the second sheet member 3 at the time when it is pressed may be reduced by providing the resin 40, by appropriately selecting a material having predetermined flexibility for the resin 40 as mentioned above, reduction in the usability is avoided. It should be noted that the resin 40 may be formed by a method (injection molding) in which the resin 40 is poured into a metal mold after attaching the first sheet member 2 and the second sheet member 3 inside the metal mold.

In the switch unit 1B according to this variation, the first sheet member 2 and the second sheet member 3 are integrally formed. Hence, it is possible to position the dome movable contacts 5 provided to the first sheet member 2 and the light-emitting parts 12 (illumination parts 11) provided to the second sheet member 3 with good accuracy. Thus, it is possible for the illumination parts 11 to directly and positively illuminate the switch operating positions (the positions at which the key tops 22 are provided).

In the above-mentioned embodiment, the area of each light-emitting part 12 may be smaller than, equal to, or larger than the area of the corresponding dome movable contact 5 (the light emitting parts are formed in the vicinities of the dome movable contacts 5). However, this is not a limitation of the area of each light-emitting part 12. The light-emitting parts 12 may be formed over substantially an entire surface of the second sheet member 3. With such a structure, it is possible to illuminate substantially the entire surface (wide area) of the second sheet member 3 while reducing the thickness and rigidity of the switch unit (1A, 1B).

The present invention is not limited to the specifically disclosed embodiments, and variations and modifications may be made without departing from the scope of the present invention.

The present application is based on Japanese Priority Application No. 2003-389712 filed on Nov. 19, 2003, the entire contents of which are hereby incorporated by reference.

What is claimed is:

1. A switch unit comprising:

a first sheet member including a plurality of movable contacts; and a second sheet member provided on the first sheet member and having a first surface facing the second sheet member and a second surface opposite to the first surface, the second sheet member including a plurality of light-emitting parts formed on the first surface and wiring that supplies power to the light-emitting parts, wherein the wiring is made of a conductive polymer; and the light emitting parts are isolated from each other and protrude toward the first sheet member so that the second surface of the second sheet member is flat.

2. The switch unit as claimed in claim 1, wherein the light-emitting part and the movable contact are arranged to face each other at least partially.

3. The switch unit as claimed in claim 2, wherein the conductive polymer is transparent.

4. The switch unit as claimed in claim 2, wherein the movable contact is formed by a dome-like metallic spring.

5. The switch unit as claimed in claim 2, wherein the wiring supplies power to the light-emitting part at a position facing the movable contact.

6. The switch unit as claimed in claim 2, wherein the light-emitting part is formed to cover substantially an entire surface of the second sheet member.

7. The switch unit as claimed in claim 1, wherein the conductive polymer is transparent.

8. The switch unit as claimed in claim 7, wherein the movable contact is formed by a dome-like metallic spring.

9. The switch unit as claimed in claim 7, wherein the wiring supplies power to the light-emitting part at a position facing the movable contact.

10. The switch unit as claimed in claim 7, wherein the light-emitting part is formed to cover substantially an entire surface of the second sheet member.

11. The switch unit as claimed in claim 1, wherein the movable contact is formed by a dome-like metallic spring.

12. The switch unit as claimed in claim 11, wherein the wiring supplies power to the light-emitting part at a position facing the movable contact.

13. The switch unit as claimed in claim 11, wherein the light-emitting part is formed to cover substantially an entire surface of the second sheet member.

14. The switch unit as claimed in claim 1, wherein the wiring supplies power to the light-emitting part at a position facing the movable contact.

15. The switch unit as claimed in claim 14, wherein the light-emitting part is formed to cover substantially an entire surface of the second sheet member.

16. The switch unit as claimed in claim 1, wherein the light-emitting part is farmed to cover substantially an entire surface of the second sheet member.

17. The switch unit as claimed in claim 1, wherein a spacer is provided between the first sheet member and the second sheet member.

18. The switch unit as claimed in claim 1, wherein a resin is supplied to fill in between the first sheet member and the second sheet member so that the first sheet member and the second sheet member constitute an integrated structure.

19. A switch unit comprising:

a first sheet member including a plurality of movable contacts; and a second sheet member provided on the first sheet member and having a first surface facing the second sheet member and a second surface opposite to the first surface, the second sheet member and including a plurality of light-emitting parts formed on the first surface and wiring that supplied power to the light-emitting parts, wherein the wiring is made of a conductive polymer; and the light emitting parts are Isolated from each other.

20. A switch unit comprising:

a first sheet member including a plurality of movable contacts; and a second sheet member provided on the first sheet member and having a first surface facing the second sheet member and second surface opposite to the first surface, the second sheet member and including a plurality of light-emitting parts formed on the first surface and wiring that supplies power to the light-emitting parts, wherein the wiring is made of a conductive polymer; and the light-emitting parts protrude toward the first sheet member so that the second surface of the second sheet member is flat.

* * * * *